US012791272B1

(12) United States Patent
Kraft

(10) Patent No.: US 12,791,272 B1
(45) **Date of Patent: *Nov. 10, 2026**

(54) SINGLE-USE MAGAZINES AND METHODS OF MAKING AND USING SAME

(71) Applicant: Rekon, LLC, Pittsburg, KS (US)

(72) Inventor: Ryan E. Kraft, Fort Scott, KS (US)

(73) Assignee: Rekon, LLC, Pittsburg, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/981,956

(22) Filed: Dec. 16, 2024

Related U.S. Application Data

(63) Continuation of application No. 18/401,229, filed on Dec. 29, 2023, now Pat. No. 12,169,112, which is a continuation of application No. 17/816,626, filed on Aug. 1, 2022, now Pat. No. 11,859,937, which is a continuation of application No. 17/241,511, filed on Apr. 27, 2021, now Pat. No. 11,402,167.

(60) Provisional application No. 63/016,069, filed on Apr. 27, 2020.

(51) Int. Cl.
*F41A 9/70* (2006.01)
*F41A 9/65* (2006.01)

(52) U.S. Cl.
CPC .. *F41A 9/70* (2013.01); *F41A 9/65* (2013.01)

(58) Field of Classification Search
CPC ..... F41A 9/70; F41A 9/65
See application file for complete search history.

(56) References Cited

U.S. PATENT DOCUMENTS

| | | | | |
|---|---|---|---|---|
| 1,323,063 | A | 11/1919 | Johnson et al. | |
| 3,399,480 | A | 9/1968 | Rowe, Jr. | |
| 3,443,334 | A | 5/1969 | Ardolino | |
| 3,453,762 | A | 7/1969 | Fremont | |
| 4,027,415 | A | 6/1977 | Stoner | |
| 4,413,437 | A | 11/1983 | Anderson | |
| 4,442,962 | A | 4/1984 | Musgrave | |
| 4,901,463 | A * | 2/1990 | Chesnut | F41A 9/65 42/50 |
| 5,113,605 | A | 5/1992 | Kim | |
| 8,677,880 | B2 * | 3/2014 | Bowles | F41A 9/70 89/34 |
| 10,393,457 | B2 | 8/2019 | Fitzpatrick et al. | |
| 10,436,532 | B2 | 10/2019 | Walton | |
| 10,527,374 | B1 | 1/2020 | August | |
| 11,402,167 | B1 | 8/2022 | Kraft | |
| 11,859,937 | B1 | 1/2024 | Kraft | |
| 12,169,112 | B1 * | 12/2024 | Kraft | F41A 9/70 |
| 2021/0156639 | A1 | 5/2021 | Kirsch | |

FOREIGN PATENT DOCUMENTS

| | | | |
|---|---|---|---|
| KR | 101652077 | B1 | 9/2016 |
| WO | 2009025889 | A2 | 2/2009 |

* cited by examiner

*Primary Examiner* — Reginald S Tillman, Jr.
(74) *Attorney, Agent, or Firm* — AVEK IP, LLC

(57) ABSTRACT

A magazine for a firearm may include a first portion. The first portion may include a first primary wall and at least one locking member. The at least one locking member extends from the first portion. The magazine may include a second portion. The second portion may include a second primary wall. The second portion may be configured to be locked to the first portion via the at least one locking member. The magazine may include a cavity collectively formed by the first portion and the second portion. The cavity may be configured to retain a projectile.

20 Claims, 9 Drawing Sheets

FIG. 1 – PRIOR ART

FIG. 2 – PRIOR ART

SINGLE-USE MAGAZINES AND METHODS OF MAKING AND USING SAME

RELATED APPLICATIONS

This application is a continuation of U.S. Non-Provisional application Ser. No. 18/401,229, filed Dec. 29, 2023, set to issue as U.S. Pat. No. 12,169,112, which is a continuation of U.S. Non-Provisional application Ser. No. 17/816,626, filed Aug. 1, 2022, now U.S. Pat. No. 11,859,937, which is a continuation of U.S. Non-Provisional application Ser. No. 17/241,511, filed on Apr. 27, 2021, now U.S. Pat. No. 11,402,167, which claims the benefit of U.S. Provisional Application No. 63/016,069, filed on Apr. 27, 2020. The disclosure of these applications is incorporated by reference in their entirety.

FIELD OF THE DISCLOSURE

The disclosure relates generally to the field of ammunition magazines. More specifically, the disclosure relates to single-use magazines.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In some aspects, the techniques described herein relate to a magazine for a firearm. The magazine includes a first portion having a first primary wall and at least one locking member. The at least one locking member extends from the first portion. The magazine includes a second portion having a second primary wall. The second portion is configured to be locked to the first portion via the at least one locking member. The magazine includes a cavity collectively formed by the first portion and the second portion. The cavity is configured to retain a projectile.

In some aspects, the techniques described herein relate to a magazine for a firearm. The magazine includes a first portion having a first primary wall, a first sidewall, and a second sidewall. The magazine includes a second portion having a second primary wall, a third sidewall, and a fourth sidewall. The magazine includes a locking mechanism disposed on both the first portion and the second portion. The locking mechanism is configured to lockingly engage the first portion with the second portion.

In some aspects, the techniques described herein relate to a magazine for a firearm. The magazine includes a first portion having a first locking member and a second locking member. The first locking member and the second locking member are disposed on opposing sides of the first portion. The magazine includes a second portion configured to lockingly engage each of the first locking member and the second locking member. The magazine includes a cavity formed by the first portion and the second portion. The cavity retains a plurality of projectiles.

BRIEF DESCRIPTION OF THE SEVERAL VIEWS OF THE DRAWINGS

Illustrative embodiments of the present disclosure are described in detail below with reference to the attached drawing figures and wherein.

DETAILED DESCRIPTION

Magazines for use with firearms are known in the art. The conventional magazine stores one or more ammunition cartridges in a magazine cavity. The typical magazine also has a spring which biases the cartridges towards a chamber of the firearm to which the magazine is attached. When the topmost cartridge is ejected from the firearm, e.g., towards a target, the magazine spring pushes the next cartridge into the firearm chamber. In the prior art, magazines are configured to be reusable since their design and manufacture is complex and costly. Prior art magazines are therefore manufactured using high grade materials, such as aluminum, heavy-duty plastic, et cetera, to allow the magazines to be reused a large number of times. A shooter, e.g., an officer, a soldier, or another, first loads the prior art magazine with cartridges. Once the magazine is loaded, the shooter inserts the magazine into the firearm and shoots the firearm. When the magazine runs out of cartridges, the shooter disassociates the magazine from the firearm, and load a new magazine into the firearm. The expended magazine is then typically kept on the shooter's person so that the expended magazine may be reloaded for further use. In other words, the magazine is not intended to be disposed after only one use.

The repeated loading and reloading of cartridges into the prior art magazine may be a time consuming and cumbersome process. Further, the shooter may not wish to carry around empty magazines after the cartridges therein have been depleted. The weight of the prior art magazine, in part due to the fact that it is made to be durable and is constructed typically of heavy-duty materials, is not insignificant, and may cause discomfort to a shooter carrying a plurality of such magazines. On top of this, the prior art magazines assume a large amount of space (i.e., volume) to store, thus limiting the number of magazines a shooter may carry, whether they are loaded or expended. Another disadvantage associated with the conventional magazines is that valuable time must be taken to store the expended magazine when reloading the firearm with a fresh magazine. In some situations, this is time that the shooter cannot afford to waste. The shooter may desire to have preloaded magazines that the shooter can use as desired and simply discard thereafter. But the cost of the materials involved in making a magazine, along with the complexity of the prior art magazine design and the manufacturing costs of the various parts of the magazine, have heretofore been prohibitive such that a single-use magazine has been commercially unviable.

Figure 1:
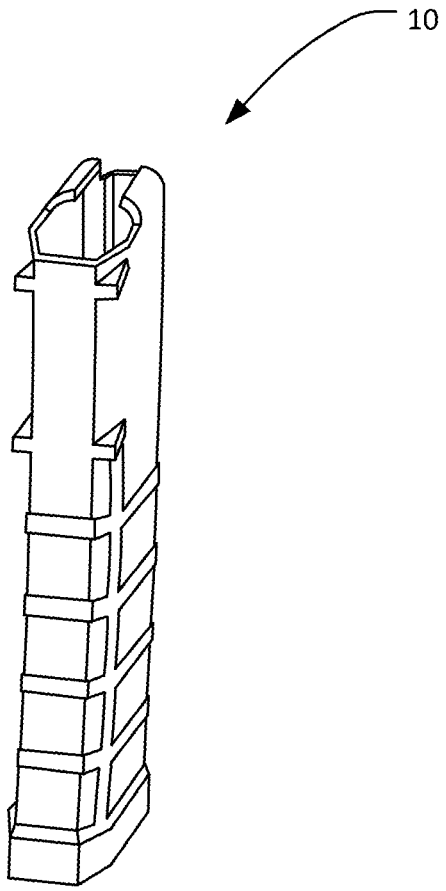
FIG. 1 is a perspective view of a PRIOR ART magazine.
Figure 2:
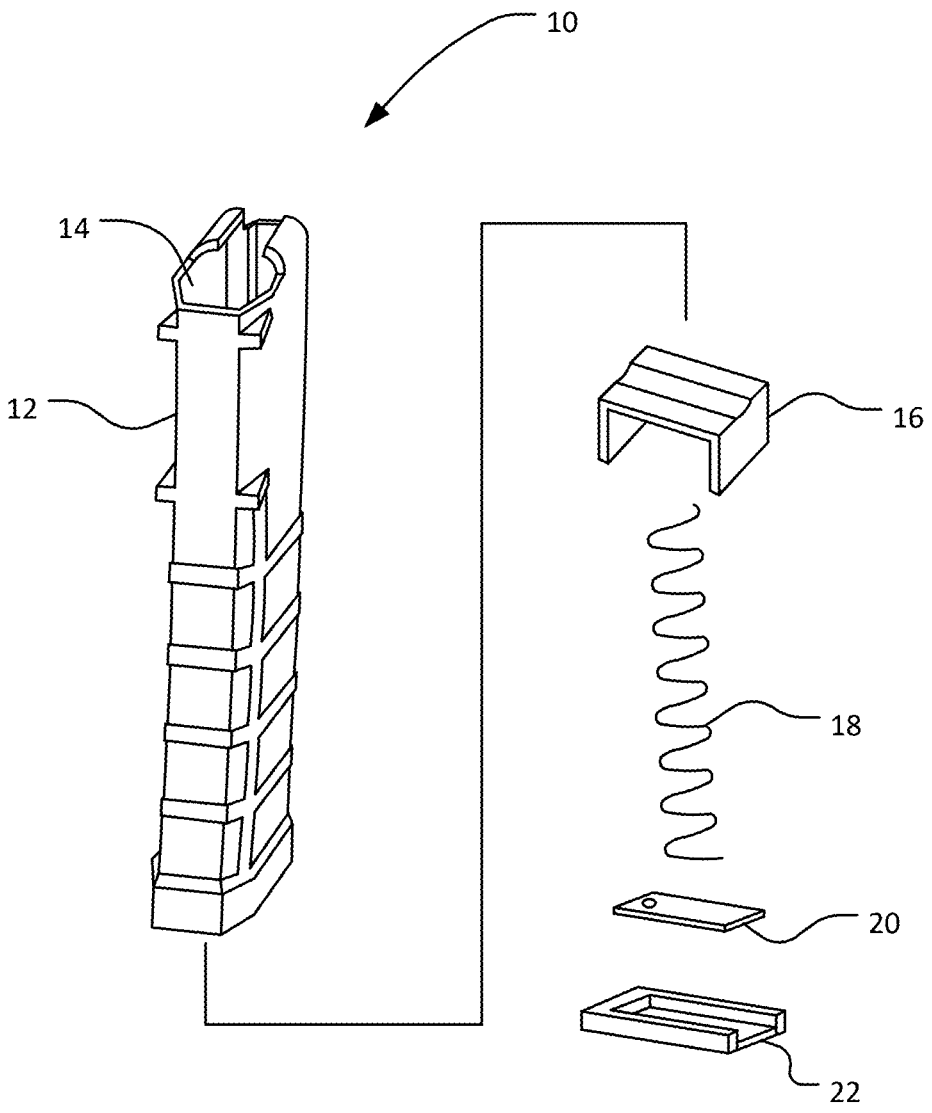
FIG. 2 schematically illustrates internals of the PRIOR ART magazine of FIG. 1.

FIG. 1 shows a prior art magazine 10 as is known in the art. FIG. 2 shows the internals of the prior art magazine 10. The magazine 10 has a housing 12 forming a cavity 14 for the reception of cartridges (i.e., ammunition). The magazine 10 typically includes a follower 16, a spring 18, a retainer plate 20, and a base plate 22. The housing shell 12 typically includes at least two parts that are fusion welded together to form the completed housing 12.

As is known, the follower 16 is in contact with an upper end of the spring 18. The follower 16 helps to compress the spring 18 when rounds (i.e., ammunition, cartridges, etc.) are inserted into the magazine 10. The follower 16 pushes the rounds up as the topmost round is removed (e.g., by being fired from a firearm). The retainer plate 20 is in contact with the lower end of the spring 18, opposite the follower 16. The base plate 22 is removably secured to the magazine housing 12 and ensures that the spring 18 does not undesirably decouple from the magazine 10. Prior art magazines may further include a pin which assists in the retention of the spring 18.

In some prior art magazines, a flat piece of plastic with a nub is situated at the bottom of the spring. The base plate has an opening corresponding to the nub. When the base plate is slid on a track at the bottom of the housing, the nub comes out the hole in the base plate to lock the base plate in place. The nub can be pushed into the magazine, akin to a button, to unlock the base plate.

As noted, the prior art magazine is not configured for one-time use, at least in part because of the high manufacturing and assembling costs of the magazine. In terms of cost, welding one piece of the magazine housing to the other to form the completed housing 12 is a significant contributor. Substantial costs are also incurred in making a separate mold for the base plate 22, as the base plate 22 is distinct from the housing 12 and is configured to be removably coupled thereto. Further, the industry is fixated on making long-lasting magazines that can be reused numerous times, and for this reason, prior art magazines are made of high-quality materials that also increase the costs to make these magazines. Because of these costs, the artisan would consider the idea of a single-use magazine commercially infeasible.

The present disclosure relates to a magazine that, in stark contrast to the entrenched market philosophy, is configured for single use. The disclosed magazine may not require that the pieces of the magazine housing be welded together. Further, the disclosed single-use magazine may do away with a separate base plate and retainer plate. The materials used to make the magazine may be relatively inexpensive because the magazine, unlike conventional magazines, is not intended to be reused numerous times. Thus, material durability and resistance to wear may become less significant factors when choosing a magazine material. Instead, a cheaper and/or lighter material may be used.

Figure 3:
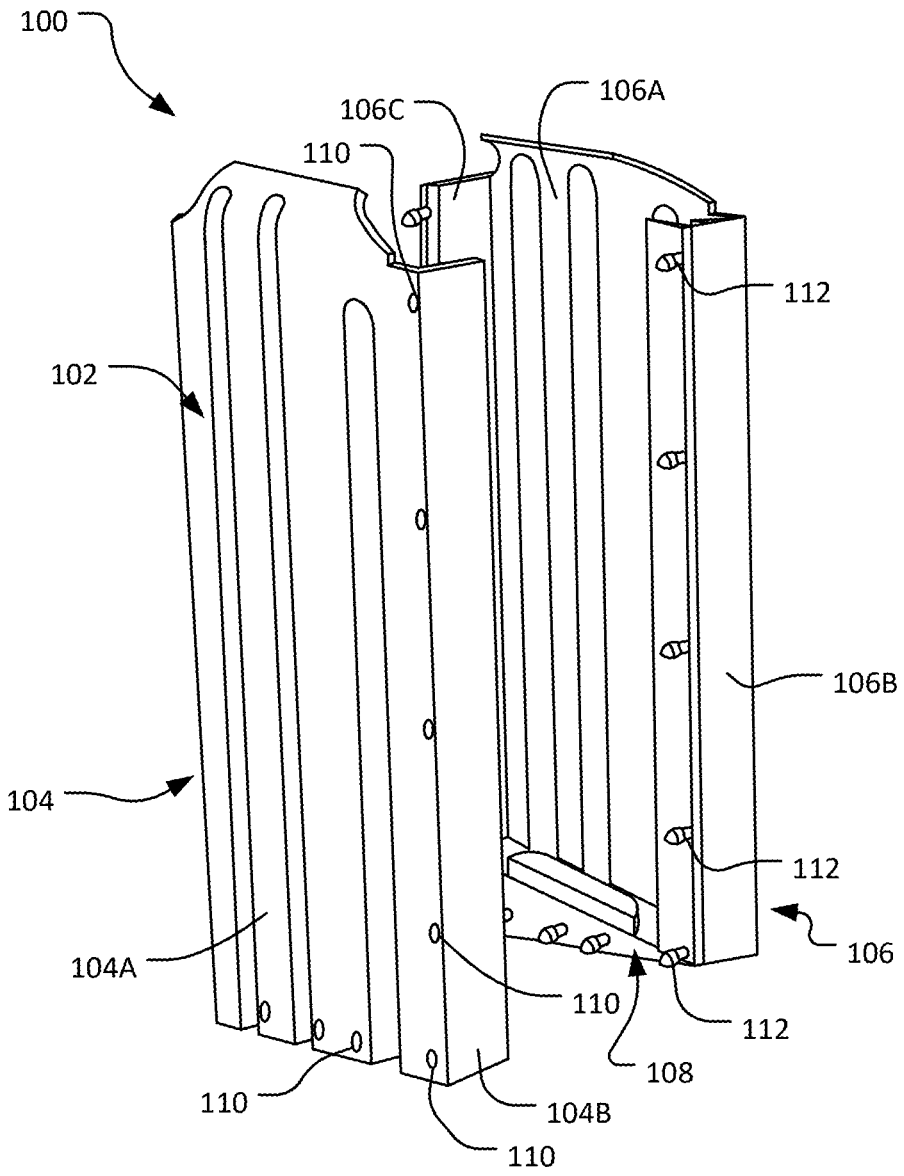
FIG. 3 is perspective view of a magazine according to an embodiment of the present disclosure, shown in an initial or unassembled configuration.
Figure 4:
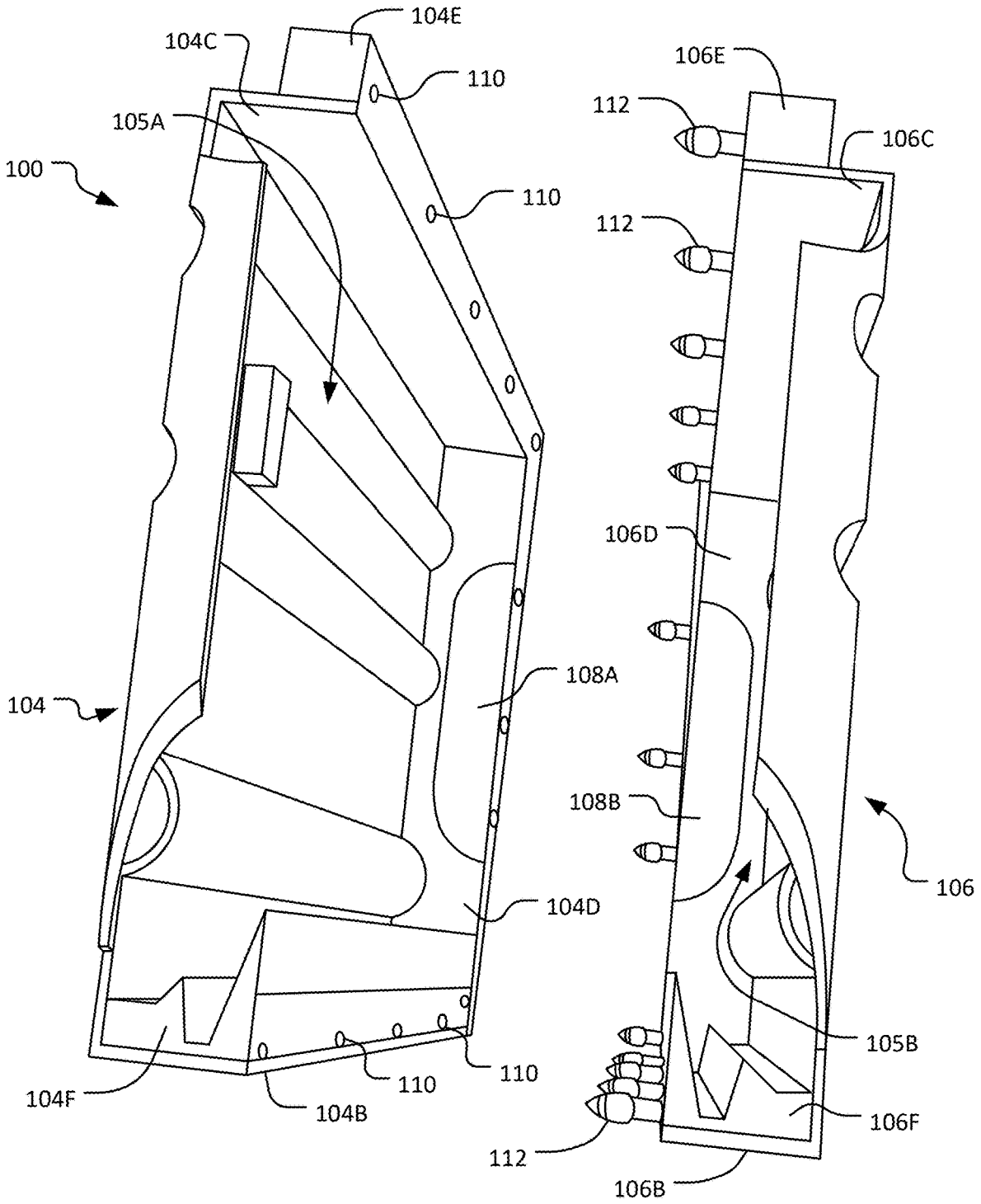
FIG. 4 is a top perspective view of the magazine of FIG. 3 in the unassembled configuration.
Figure 5:
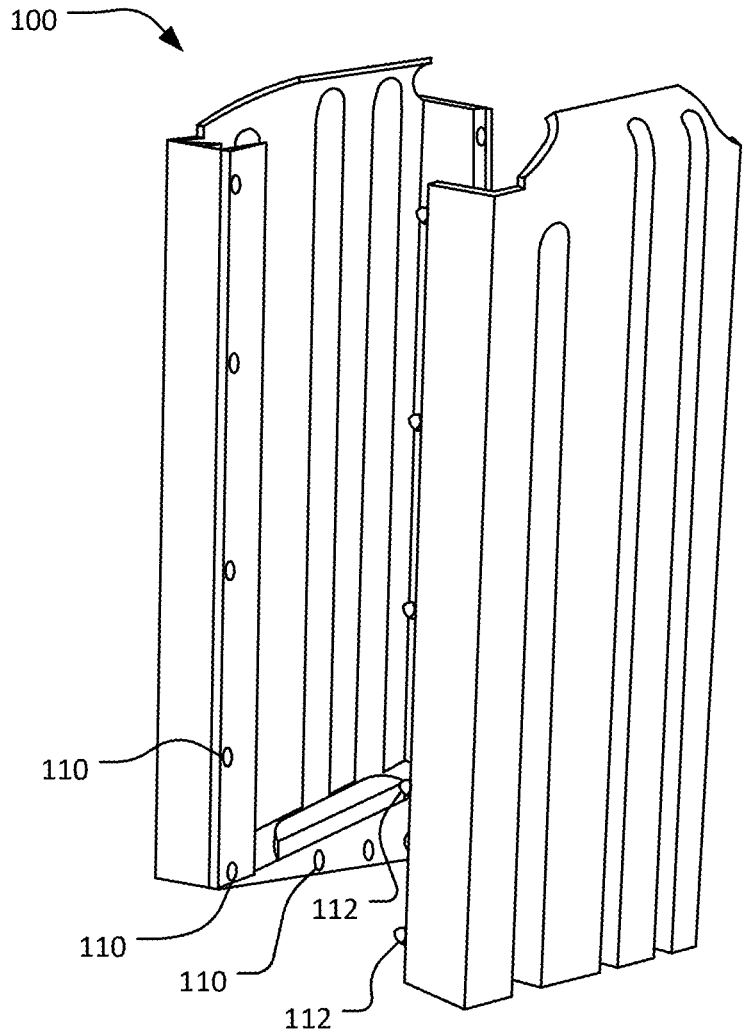
FIG. 5 is another perspective view of the magazine of FIG. 3 in the unassembled configuration.

FIGS. 3-5 shows a single-use magazine 100, according to an embodiment. The magazine 100 comprises a housing 102 having a first portion 104 and a second portion 106, a spring register 108, and a spring and follower akin to the prior art. The spring and the follower may be joined together as a solitary component. In embodiments, the single-use magazine 100 does not have a separable base plate nor a retainer plate.

Figure 9:
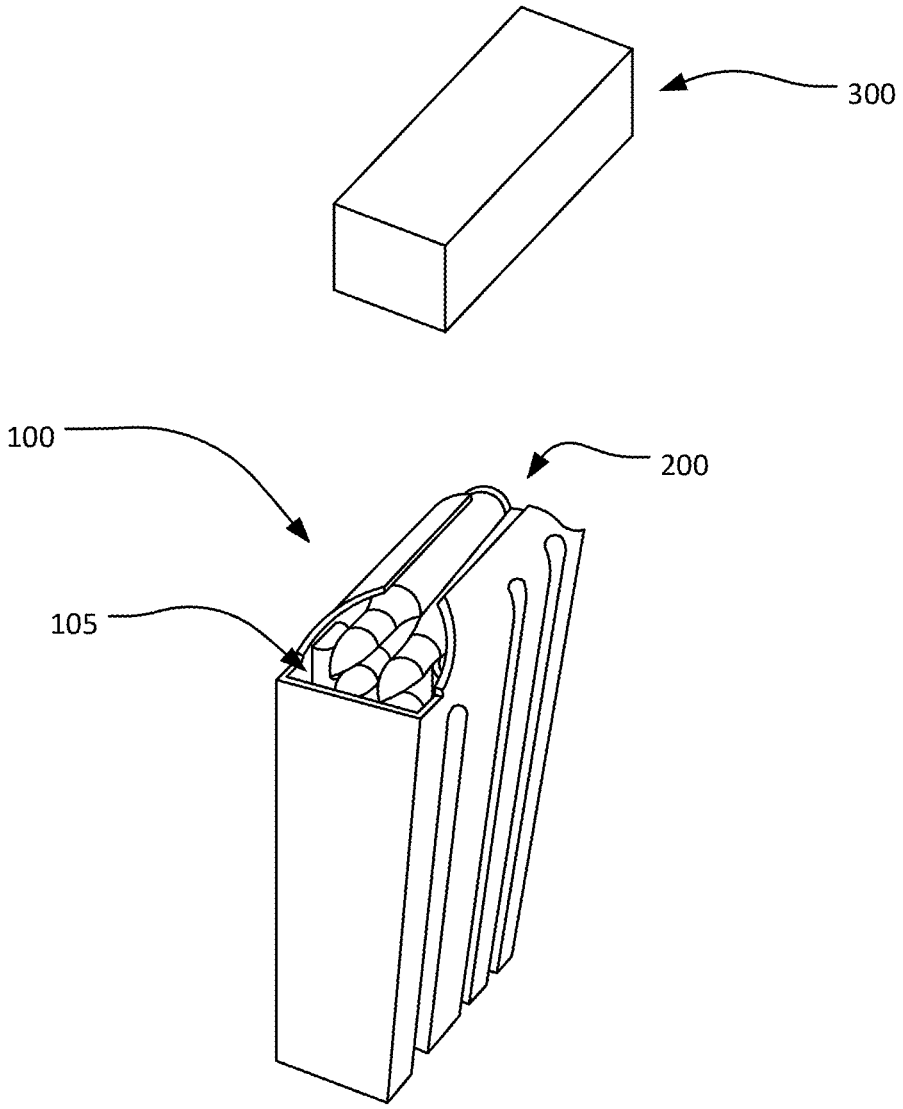
FIG. 9 shows a perspective view of the magazine of FIG. 3 in a final or assembled configuration.

The housing first portion 104 and the second portion 106 may be collectively configured to form a cavity for retaining cartridges that are fed to the firearm with the assistance of the spring and follower. The housing first portion 104 may comprise a primary or base wall 104A, side walls or edges 104B and 104C (see FIGS. 3-4), and a bottom wall 104D. The side walls 104B and 104C and the bottom wall 104D may each extend generally perpendicular to the base wall 104A and may face the housing second portion 106 when the magazine 100 is in the assembled configuration. The base wall 104A, side walls 104B and 104C, and the bottom wall 104D may collectively form a part 105A of the cavity 105 (see FIG. 9) within which the cartridges are housed. In embodiments, a reinforced rail 104E may be provided outwardly adjacent one of the side walls (e.g., outwardly adjacent the side wall 104C (FIG. 4)). Further, a double rail 104F may be provided inwardly adjacent the other side wall (e.g., inwardly adjacent the sidewall 104B (FIG. 4)). The outwardly adjacent reinforced rail 104E and the inwardly adjacent double rail 104F may each contribute to the structural integrity of the magazine 100.

The housing second portion 106 may likewise comprise a primary or base wall 106A, side walls or edges 106B and 106C, and a bottom wall 106D. The side walls 106B and 106C and the bottom wall 106D may each be generally perpendicular to the base wall 106A and may extend towards the housing first portion 104 when the magazine 100 is in the assembled configuration. The second portion base wall 106A, side walls 106B and 106C, and the bottom wall 106D may collectively form a part 105B of the cavity 105 (see FIG. 9) within which the cartridges will be housed. In embodiments, a reinforced rail 106E may be provided outwardly adjacent one of the side walls (e.g., outwardly adjacent the side wall 106C as shown (FIG. 4)). A double rail 106F may be provided inwardly adjacent the other side wall (e.g., inwardly adjacent the sidewall 106B (FIG. 4)). As discussed with respect to the first portion 104, the outwardly adjacent reinforced rail 106E and the inwardly adjacent double rail 106F of the second portion 106 may each contribute to the structural integrity of the magazine 100.

Figure 6:
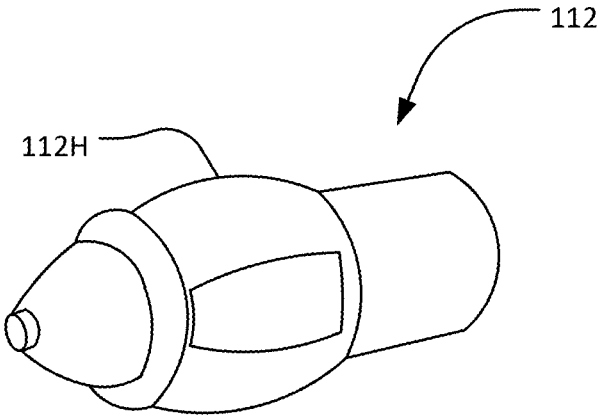
FIG. 6 illustrates one male locking member of the magazine in additional detail.
Figure 7:
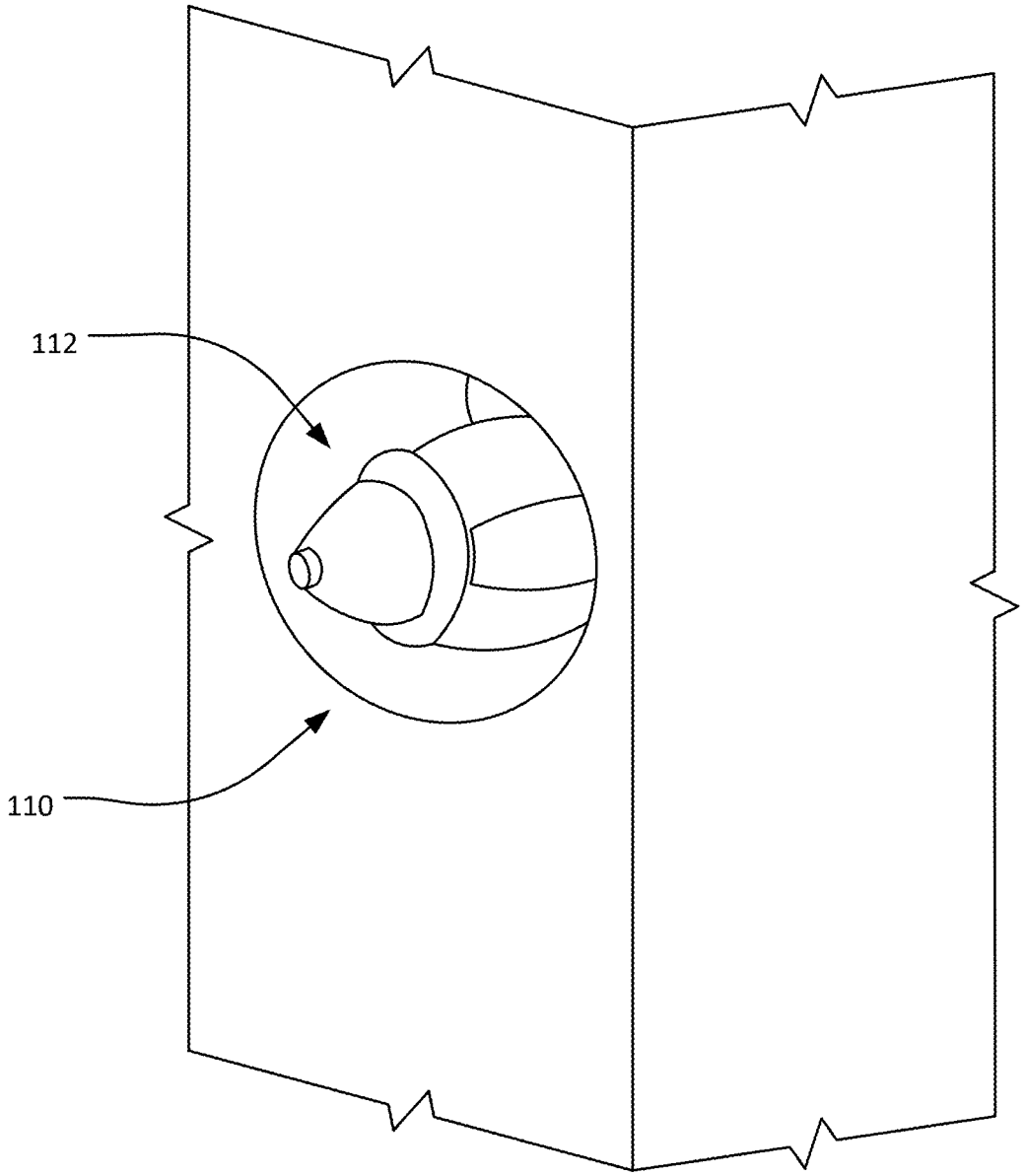
FIG. 7 illustrates one male locking member of the magazine mated with a corresponding female locking member of the magazine.
Figure 8:
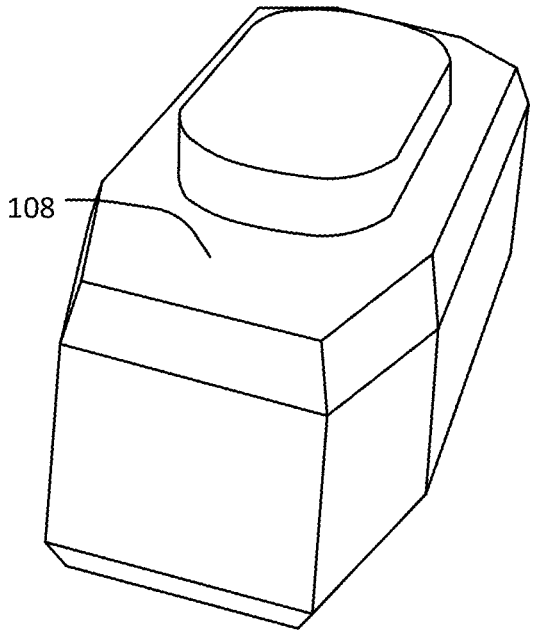
FIG. 8 shows a spring register of the magazine of FIG. 3.

To eliminate the need for welding, the housing first portion 104 and the housing second portion 106 may be configured to be mechanically joined to form the cavity 105 for housing of cartridges and the spring and follower. The apparatus for mechanically joining the housing first portion 104 and the housing second portion 106 may include fasteners and/or integral joints. For example, nuts and bolts, screws, pins, rivets, seams, et cetera, may be used to mechanically join the first portion 104 and the second portion 106. In an embodiment, the first portion 104 and the second portion 106 may have female and corresponding male mating members configured to readily mate with each other to cause the first portion 104 to mechanically interlock with (e.g., snap to) the second portion 106. For example, in the embodiment illustrated in FIGS. 3-5, the second portion 106 may have a plurality of protruding members 112 and the first portion 104 may have a plurality of corresponding openings 110. Each protruding member 112 on the housing second portion 106 may have a mushroom-shaped head 112H (see FIGS. 6-7) and a corresponding mushroom opening 110 may be configured on the housing first portion 104 to lockingly accept the mushroom-shaped head 112 to collectively cause the housing first portion 104 and the housing second portion 106 to couple together (e.g., the housing first portion 104 and the housing second portion 106 may click together). In embodiments, the configuration of the female members 110 and the corresponding male members 112 may be such that once the housing first portion 104 and the second portion 106 are snapped together, they remain joined to each other during normal use. That is, the coupling between the first portion 104 and the second portion 106 may be configured to be permanent. For example, the mushroom-shaped protruding members 112 may be designed to be strong enough to lockingly engage with the female members 110 for ordinary use, but may be designed to break apart if a user forcibly attempts to separate the first portion 104 from the second portion 106 after the two portions 104, 106 have been snapped together.

For ensuring a secure lock, the protruding members 112 may be provided on or proximate each of the side walls 106B and 106C and the bottom wall 106D of the housing second portion 106, and the corresponding openings may likewise be provided on or proximate each of the side walls 104B and 104C and the bottom wall 104D of the housing first portion 104. By virtue of the number, arrangement, and configuration of the protruding members 112 and the corresponding openings 110, when the first portion 104 and the second portion 106 are locked together, the side wall 104B, side wall 104C, and bottom wall 104D of the first portion 104 may respectively be adjacent and in contact with the side wall 106B, side wall 106C, and bottom wall 106D of the second portion 106. In an embodiment, at least some of the protruding members 112 may be provided on the reinforced rail 106E of the second portion 106, and the mushroom openings 110 corresponding thereto may be provided on the reinforced rail 104E of the first portion 104. Having at least a portion of the protruding members 112 and the corresponding openings 110 on the reinforced rails 106E and 104E, respectively, may further fortify the locking mechanism.

The artisan will understand from the disclosure herein that the locking system comprising the female members 110 and the male members 112 depicted in the figures is exemplary and is not intended to be independently limiting. For example, while FIGS. 3-5 show that a certain number of male members 112 are arranged in a vertical line along each of the side walls 106B, 106C walls of the housing second portion 106, and that a particular number of male members 112 are arranged laterally along the bottom wall 104D of the housing second portion 106, this arrangement of the male members 112, together with the corresponding arrangement of the female members 110, is exemplary. For instance, a different number of male members 112 may be provided on or proximate the side walls 106B, 106C and/or bottom wall 106D, and the protruding members 112 may be arranged in locations other than those shown. Further, the male and the female members 112, 110 may be arranged such that each housing portion 104, 106 may include at least one of each. Other variations of the disclosed locking mechanism, and other locking mechanisms that do not employ welding, will become apparent to the artisan from the disclosure herein.

The housing 102, including the first portion 104 and/or the second portion 106 thereof, may be made of light-weight and/or durable material, such as bamboo/poly mix, Kevlar, polypropylene/polyethylene mix, various plastics/polymers, recycled material, et cetera. However, since the magazine 100 is intended to be a single-use magazine, unlike in the prior art, the raw materials may not be selected with an eye towards ensuring that magazine be capable of being reused a number of times.

The artisan would understand that the specific shape, size, and configuration of the magazine 100 shown in the figures is one exemplary embodiment of many, and that embodiments of the single-use magazine described herein are not limited to what is depicted in the figures. The artisan would also understand that embodiments of the single-use magazine may be any suitable shape, size, and/or configuration of ammunition-holding magazine (e.g., an assault rifle magazine, a carbine magazine, a pistol magazine, a shotgun magazine, etc.) now known or subsequently developed. For example, embodiments of the single-use magazine may comply with NATO's STANAG standards. As another example, embodiments of the single-use magazine may have any desirable capacity (e.g., the single-use magazine may have a ten-round capacity, a twenty-round capacity, a thirty-round capacity, et cetera). As yet another example, embodiments of the single-use magazine may retain ammunition in a single column configuration, in a double stack configuration, a casket configuration, a drum configuration, a saddle-drum configuration, a horizontal configuration, a rotary configuration, a pan/disc configuration, a helical configuration, et cetera. As still another example, embodiments of the single-use magazine may be configured to retain any suitable caliber of ammunition, such as 5.56×45 mm rounds, 5.45×39 mm rounds, 7.62×51 mm rounds, .22LR rounds, 9×19 mm rounds, .45 ACP rounds, 12-gauge shotgun rounds, et cetera.

The spring register 108 (see FIG. 3) may, as shown in FIG. 4, comprise a first portion 108A and a second portion 108B. The spring register first portion 108A may be part of the housing first portion 104, and specifically, be situated on the bottom wall 104D thereof. Similarly, the spring register second portion 108B may be part of the housing second portion 106 and be situated on the bottom wall 106D thereof. The first spring register portion 108A may be complementary to the second register portion 108B (e.g., the first portion 108A may be generally identical to the second portion and be a mirror opposite thereof). Locking engagement of the housing first portion 104 to the housing second portion 106 may cause the register portions 108A, 108B to come adjacent and in contact with each other to complete the spring register 108. The spring register 108 may be configured, for example, to securely hold the spring 18 and follower 16 in place, and eliminate the need for a pin as is used in certain prior art magazines. In embodiments, the spring register 108 may be specifically configured to mate with and retain the spring 18, such as through the use of grooves, recesses, mechanical locks, apertures, et cetera. The double rail 106F may ensure improved registration of the flexible spring within the housing 102. The artisan will understand that the spring may be in contact with the spring register 108 and that the spring and the follower may be sandwiched between the housing first and second portions 104 and 106.

In embodiments, the primary wall 104A, side walls 104B and 104C, bottom wall 104D, rails 104E and 104F, and the spring register portion 108A of the housing first portion 104, may all be part of the mold of the housing first portion 104. Similarly, the primary wall 106A, side walls 106B and 106C, bottom wall 106D, rails 106E and 106F, and the spring register portion 108B of the housing second portion 106, may all be part of the mold of the housing second portion 106. Such may eliminate the need to have separate molds for the various components as in the prior art (e.g., a separate mold for the base plate). This, together with the fact that the magazine portions need not be welded together and may be made of low-priced materials, may allow the magazine 100 to be manufactured quite inexpensively relative to the prior art magazine 10.

To form the magazine, the housing first portion 104 and the housing second portion 106 may be placed together in a jig and compressed with a spring and follower therebetween, which may cause the male and female locking members 110, 112 to interlock such that the spring comes in registry with the completed spring register 108. Because the magazine 100 is not configured to be opened, it may be loaded with ammunition 200 (FIG. 9) before the first portion 104 and the second portion 106 are lockingly engaged. The loaded magazine 100 (see FIG. 9) may be sold to the consumer in a package, and appropriate indicia (e.g., branding, instructions for use, legal information, et cetera) may be placed on the magazine 100 and/or the packaging thereof. Because of the advancements discussed herein, the magazine 100 may be manufactured inexpensively and be configured for single use. The shooter may purchase the preloaded magazine 100, fire the cartridges 200 therein, and then simply discard the magazine 100, thereby obviating the need to carry around empty magazines and the hassle associated with loading and reloading same. In embodiments, the magazine 100 or portions thereof may be configured to be recycled. In some embodiments, the magazine 100 may be provided with a cap 300 that may be placed over the top of the magazine 100. In operation, the cap 300 may serve to protect and/or retain the ammunition 200 stored within the magazine 100 from the elements (e.g., moisture, heat, et cetera). The cap 300 may be removed prior to loading the magazine 100 into the firearm. The cap 300 may be made of the same or similar material as the magazine 100, and may likewise be disposable after use.

Many different arrangements of the various components depicted, as well as components not shown, are possible without departing from the spirit and scope of the present disclosure. For example, while the magazine 100 depicted in the figures is shown as housing a certain type of ammunition, the artisan will understand the magazine 100 may be configured to house different types of ammunition. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims.

The disclosure claimed is:

1. A magazine for a firearm, comprising:

a first portion comprising a first wall, a first part of a spring register, and a protrusion extending from said first portion;

a second portion comprising a second wall, a second part of a spring register, and an opening; and a cavity collectively formed by said first portion and said second portion, said cavity being configured to retain a projectile;

wherein said protrusion and said opening are configured to be joinable such that said protrusion and said opening lockingly engage said first portion with said second portion.

2. The magazine of claim 1, wherein said first portion comprises a second protrusion and said second portion comprises a second opening configured to receive said second protrusion.

3. The magazine of claim 1, wherein said protrusion and said opening are configured to permanently lockingly engage.

4. The magazine of claim 1, wherein said protrusion comprises an enlarged head.

5. The magazine of claim 1, wherein said first part of said spring register and said second part of said spring register collectively form said spring register when said first portion is mated to said second portion.

6. The magazine of claim 1, wherein said first portion and said second portion are each constructed of plastic.

7. The magazine of claim 6, wherein said magazine is configured to be disposable.

8. The magazine of claim 1, further comprising a reinforced rail adjacent a sidewall of said first portion.

9. The magazine of claim 8, wherein said protrusion is disposed on said reinforced rail.

10. The magazine of claim 1, further comprising a cap configured to preclude said projectile from exiting said cavity from a top end of said magazine.

11. The magazine of claim 1, further comprising a double rail adjacent a sidewall of said second portion.

12. The magazine of claim 11, wherein said double rail includes a second opening.

13. A magazine for a firearm, comprising:

a first portion comprising a first primary wall, a protrusion, a first sidewall, and a second sidewall;

a second portion comprising a second primary wall, an opening, a third sidewall, and a fourth sidewall; and a spring register located at a bottom end of said first portion and said second portion;

wherein, said protrusion and said opening are configured to be joinable such that said protrusion and said opening lockingly engage said first portion with said second portion.

14. The magazine of claim 13, further comprising a second protrusion on said first portion and a second opening on said second portion.

15. The magazine of claim 13, wherein said magazine is configured for one-time use.

16. The magazine of claim 13, further comprising a projectile arranged within a cavity, said cavity being formed by said first portion and said second portion when said first portion and said second portion are lockingly engaged.

17. A magazine for a firearm, comprising:

a first portion having a first protrusion and a second protrusion, said first protrusion and said second protrusion being disposed on opposing sides of said first portion;

a second portion configured to lockingly engage each of said first protrusion and said second protrusion;

a cavity formed by said first portion and said second portion, said cavity retaining a plurality of projectiles; and a removable cap configured to preclude said plurality of projectiles from exiting a top end of said cavity.

18. The magazine of claim 17, wherein each of said first protrusion and said second protrusion is integrally formed with said first portion.

19. The magazine of claim 17, wherein said first portion and said second portion are each constructed of polymer.

20. The magazine of claim 17, wherein said removable cap is configured to mate with exterior surfaces of both said first portion and said second portion.

* * * * *